US009027651B2

(12) United States Patent
Frisby et al.

(10) Patent No.: US 9,027,651 B2
(45) Date of Patent: May 12, 2015

(54) BARRIER VALVE SYSTEM AND METHOD OF CLOSING SAME BY WITHDRAWING UPPER COMPLETION

(75) Inventors: Raymond A. Frisby, Houston, TX (US); Jeffrey S. Phillips, The Woodlands, TX (US); Roy N. Nelson, Houston, TX (US); Donald Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 389 days.

(21) Appl. No.: 13/433,991

(22) Filed: Mar. 29, 2012

(65) Prior Publication Data

US 2013/0075108 A1 Mar. 28, 2013

Related U.S. Application Data

(63) Continuation-in-part of application No. 12/961,954, filed on Dec. 7, 2010, now Pat. No. 8,813,855.

(51) Int. Cl.

| | |
|---|---|
| ***E21B 34/14*** | (2006.01) |
| ***E21B 34/00*** | (2006.01) |
| ***E21B 34/06*** | (2006.01) |
| ***E21B 43/14*** | (2006.01) |

(52) U.S. Cl.

CPC ..... *E21B 34/14* (2013.01); *E21B 34/00* (2013.01); *E21B 34/06* (2013.01); *E21B 43/14* (2013.01)

(58) Field of Classification Search

CPC ..... E21B 23/02; E21B 23/06; E21B 34/105; E21B 34/12; E21B 34/14

USPC ..... 166/373, 377, 378, 380, 381, 322, 316, 166/162, 165, 332.5, 332.4

See application file for complete search history.

(56) References Cited

U.S. PATENT DOCUMENTS

| | | | |
|---|---|---|---|
| 3,493,052 | A | 2/1970 | Evans et al. |
| 4,274,486 | A | 6/1981 | Fredd |
| 4,382,623 | A | 5/1983 | Richardson |
| 4,942,926 | A | 7/1990 | Lessi |
| 5,058,682 | A | 10/1991 | Pringle |
| 5,311,939 | A | 5/1994 | Pringle |
| 5,372,193 | A | 12/1994 | French |
| 5,465,787 | A | 11/1995 | Roth |
| 5,831,156 | A | 11/1998 | Mullins |
| 5,865,251 | A | 2/1999 | Rebardi et al. |
| 5,875,852 | A | 3/1999 | Floyd et al. |
| 6,302,216 | B1 | 10/2001 | Patel |
| 6,352,119 | B1 | 3/2002 | Patel |

(Continued)

FOREIGN PATENT DOCUMENTS

WO 2011005826 A1 1/2011

OTHER PUBLICATIONS

Great Britain Search Report for GB Application No. 1303095.2, dated Jun. 24, 2013, pp. 1-5.

(Continued)

*Primary Examiner* — Brad Harcourt

(74) *Attorney, Agent, or Firm* — Cantor Colburn LLP

(57) ABSTRACT

A completion system, including a barrier valve transitionable between an open position and a closed position. An upper completion is operatively coupled with the barrier valve for mechanically transitioning the barrier valve to the closed position when the upper completion is withdrawn. A method of operating a completion system is also included.

15 Claims, 11 Drawing Sheets

(56) References Cited

U.S. PATENT DOCUMENTS

| | | | | |
|---|---|---|---|---|
| 6,491,102 | B2 | 12/2002 | Leismer et al. | |
| 6,516,886 | B2 | 2/2003 | Patel | |
| 6,598,675 | B2 | 7/2003 | Bussear et al. | |
| 6,675,893 | B2 | 1/2004 | Lund | |
| 6,684,950 | B2 | 2/2004 | Patel | |
| 6,695,049 | B2 | 2/2004 | Ostocke et al. | |
| 7,152,688 | B2 | 12/2006 | Richards | |
| 7,219,743 | B2 | 5/2007 | Wolters et al. | |
| 7,228,914 | B2 | 6/2007 | Chavers et al. | |
| 7,322,422 | B2 | 1/2008 | Patel | |
| 7,380,609 | B2 | 6/2008 | Page et al. | |
| 7,428,924 | B2 | 9/2008 | Patel | |
| 7,430,153 | B2 | 9/2008 | Fraser et al. | |
| 7,487,830 | B2 | 2/2009 | Wolters et al. | |
| 7,617,876 | B2 | 11/2009 | Patel et al. | |
| 7,640,977 | B2 | 1/2010 | Jonas | |
| 7,775,275 | B2 | 8/2010 | Patel | |
| 7,896,079 | B2 | 3/2011 | Dyer et al. | |
| 7,950,454 | B2 | 5/2011 | Patel et al. | |
| 8,056,628 | B2 | 11/2011 | Whitsitt et al. | |
| 8,231,947 | B2 | 7/2012 | Vaidya et al. | |
| 8,286,713 | B2 | 10/2012 | Broussard | |
| 8,353,353 | B2 | 1/2013 | Reaux | |
| 8,813,855 | B2 * | 8/2014 | Lake | 166/373 |
| 2003/0150622 | A1 | 8/2003 | Patel et al. | |
| 2003/0211768 | A1 | 11/2003 | Cameron et al. | |
| 2004/0159444 | A1 | 8/2004 | Wolters et al. | |
| 2005/0092501 | A1 * | 5/2005 | Chavers et al. | 166/386 |
| 2005/0095156 | A1 | 5/2005 | Wolters et al. | |
| 2005/0126789 | A1 | 6/2005 | Nivens et al. | |
| 2006/0151183 | A1 | 7/2006 | Turner | |
| 2007/0084607 | A1 | 4/2007 | Wright et al. | |
| 2007/0119599 | A1 | 5/2007 | Chavers et al. | |
| 2007/0227727 | A1 | 10/2007 | Patel et al. | |
| 2007/0235185 | A1 | 10/2007 | Patel et al. | |
| 2007/0295504 | A1 | 12/2007 | Patel et al. | |
| 2009/0025923 | A1 | 1/2009 | Patel et al. | |
| 2009/0078429 | A1 | 3/2009 | Du et al. | |
| 2009/0218104 | A1 | 9/2009 | Brown | |
| 2010/0206579 | A1 | 8/2010 | Guven et al. | |
| 2010/0236774 | A1 * | 9/2010 | Patel et al. | 166/66 |
| 2010/0270031 | A1 | 10/2010 | Patel | |
| 2010/0300702 | A1 | 12/2010 | Andrews et al. | |
| 2011/0192596 | A1 | 8/2011 | Patel | |
| 2011/0226479 | A1 | 9/2011 | Tippel et al. | |
| 2012/0138309 | A1 | 6/2012 | Lake | |
| 2012/0255738 | A1 | 10/2012 | Lauderdale et al. | |
| 2012/0261137 | A1 | 10/2012 | Martinez et al. | |
| 2013/0075108 | A1 | 3/2013 | Frisby et al. | |
| 2013/0075109 | A1 | 3/2013 | Frisby et al. | |
| 2013/0087344 | A1 | 4/2013 | Reid et al. | |
| 2013/0255946 | A1 | 10/2013 | Frisby et al.. | |
| 2013/0255947 | A1 | 10/2013 | Frisby et al. | |
| 2013/0255958 | A1 | 10/2013 | Frisby et al. | |
| 2013/0255961 | A1 | 10/2013 | Frisby et al. | |
| 2013/0306316 | A1 | 11/2013 | Patel | |

OTHER PUBLICATIONS

K. Munday et al., "Want to Make Tree Operations Safer? Why Not Use the DHSV as a Barrier?"; Society of Petroleum Engineers, SPE Paper No. 96337; Sep. 24, 2006.

T.A. Nassereddin et al., "Electromagnetic Surface-Controlled Sub-Surface Safety Valve: An Immediate Soluation to Secure Wells with Damaged Control Line"; Society of Petroleum Engineers, SPE Paper No. 138356; Nov. 1, 2010.

Martin P. Coronado et al., "Advanced Openhole Completions Utilizing a Simplified Zone Isolation System"; Socity of Petroleum Engineers, SPE Paper No. 77438; Sep. 29, 2002.

Notification of Transmittal of the International Search Report and the Written Opinion of the International Searching Authority; PCT/US2011/063519; Mailed Jul. 30, 2012; Korean Intellecutal Property Office; 8 pages.

L. Izquierdo et all, "Managing the Retrieval of Triple-Zone Intelligent Completions in Extended-Reach Wells Offshore California"; Society of Petroleum Engineers, SPE Paper No. 112115; Mar. 4, 2008.

Dwayne Leismer, "A System Approach to Annular Control for Total Well Safety"; Offshore Technology Conference; Paper No. OTC 7349; May 3, 1993.

International Search Report and Written Opinion; International Application No. PCT/US2013/026856; International Filing Date: Feb. 20, 2013; Date of Mailing: May 30, 2013; 14 pages.

Non Final Office action issued in U.S. Appl. No. 13/434,099, notification date Oct. 6, 2014; pp. 1-41.

* cited by examiner

BARRIER VALVE SYSTEM AND METHOD OF CLOSING SAME BY WITHDRAWING UPPER COMPLETION

CROSS REFERENCE

This application is a continuation-in-part of U.S. Non-provisional application Ser. No. 12/961,954 filed on Dec. 7, 2010, which patent application is incorporated by reference herein in its entirety.

BACKGROUND

In the downhole drilling and completion industry, there is often need to contain fluid within a formation during various operations. Conventionally, a mechanical barrier is put in the system that can be closed to contain the formation fluid when necessary. One example of a system known in the art will use a valve in operable communication with an Electric Submersible Pump (ESP) so that if/when the ESP is pulled from the downhole environment, formation fluids will be contained by the valve. While such systems are successfully used and have been for decades, in an age of increasing oversight and fail safe/failure tolerant requirements, additional systems will be well received by the art.

SUMMARY

A completion system, including a barrier valve transitionable between an open position and a closed position; and an upper completion operatively coupled with the barrier valve for mechanically transitioning the barrier valve to the closed position when the upper completion is withdrawn.

A method of operating a completion system, including withdrawing an upper completion, the upper completion operatively coupled to a barrier valve for controlling operation of the barrier valve; and closing the barrier valve mechanically due to the withdrawing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
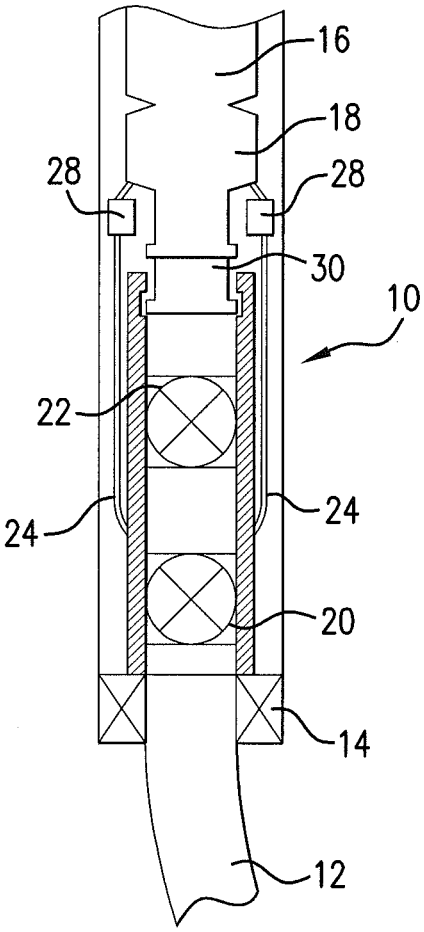
FIG. 1 is a schematic view of a stackable multi-barrier system.

Referring to FIG. 1, a stackable multi-barrier system 10 is illustrated. Illustrated is a portion of a lower completion 12, a packer 14 and a portion of an upper completion 16. One of ordinary skill in the art will be familiar with the lower completion 12 and the packer 14 and the concept of an upper completion 16 in operable communication therewith. In the illustrated embodiment an electric submersible pump (ESP) 18 is included in the upper completion 16, which is a device well known to the art. Between the illustrated ESP 18 and the lower completion 12 however, one of ordinary skill in the art will be surprised to see a number of mechanical barriers 20, 22 (sometimes referred to herein as "valves") that is greater than one. As illustrated in the figures hereof there are two but nothing in this disclosure should be construed as limiting the number of mechanical barriers to two. Rather more could also be added, if desired.

In one embodiment the more downhole valve 20 is a hydraulically actuated valve such as an ORBIT™ valve available commercially from Baker Hughes Incorporated, Houston Tex. and the more uphole valve 22 is a mechanically actuated valve such as a HALO™ valve available from the same source. It will be appreciated that these particular valves are merely exemplary and may be substituted for by other valves without departing from the invention.

Control lines 24 are provided to the valve 20 for hydraulic operation thereof. In the illustrated embodiment the lines also have a releasable control line device 28 in line therewith to allow for retrieval of the upper completion 16 apart from the lower completion 12. Also included in this embodiment of the system 10 is a stroker 30 that may be a hydraulic stroker in some iterations.

The components described function together to manage flow between the lower completion 12 and the upper completion 16. This is accomplished in that the valve 20 is settable to an open or closed position (and may be variable in some iterations) based upon hydraulic fluid pressure in the control line 24. The valve 22 is opened or closed based upon mechanical input generated by movement of the upper completion 16, or in the case of the illustration in FIG. 1, based upon mechanical movement caused by the stroker 30 that is itself powered by hydraulic fluid pressure. Of course, the stroker 30 could be electrically driven or otherwise in other embodiments. In any condition, the valve 22 is configured to close upon withdrawal of the upper completion 16. In normal production, both of the valves 20 and 22 will remain open unless there is a reason to close them. Such a reason occurs, for example, when it is required to retrieve the upper completion 16 for some reason. One such reason is to replace the ESP 18. Regardless of the reason for closure, employment of the system 10 in a completion string provides more than one mechanical barrier 20, 22 at an uphole extent of the lower completion 12. The barriers when closed prevent fluid flow after the upper completion is retrieved.

Figure 2:
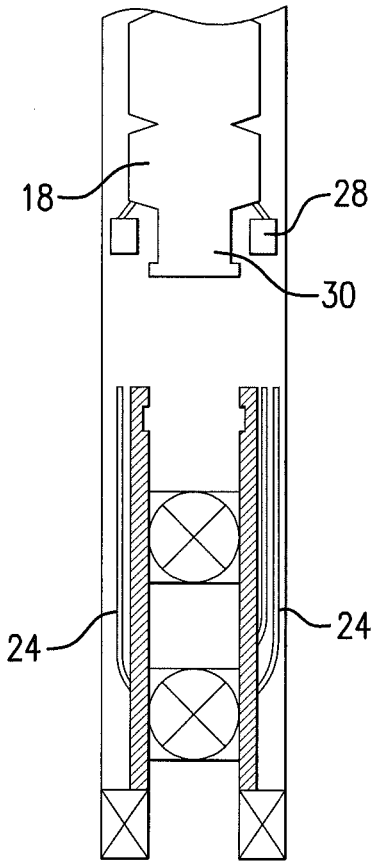
FIG. 2 is a schematic view of the system of FIG. 1 in partial withdrawal from the borehole.

Attention is directed to releasable control line devices 28 and FIG. 2. During a withdrawal of the upper completion 16, the control lines 24 are subjected to a tensile load. The releasable control line devices will release at a threshold tensile load and seal the portion of the control lines 24 that will remain in the downhole environment as a part of the lower completion string 12. The valve 20, if not already closed, is configured to close in response to this release of the control lines 24. This will complete the separation of the upper completion 16 from the lower completion 12 and allow retrieval of the upper completion 16 to the surface. With more than one mechanical barrier 20, 22 in place at the uphole extent of the lower completion 12, there is improved confidence that fluids will not escape from the lower completion 12. Important to note here briefly is that the system 10 also includes provision 44 for allowing the reopening of the valve 20 using tubing pressure after the upper completion 16 is reinstalled. This will be addressed further hereunder.

Figure 3:
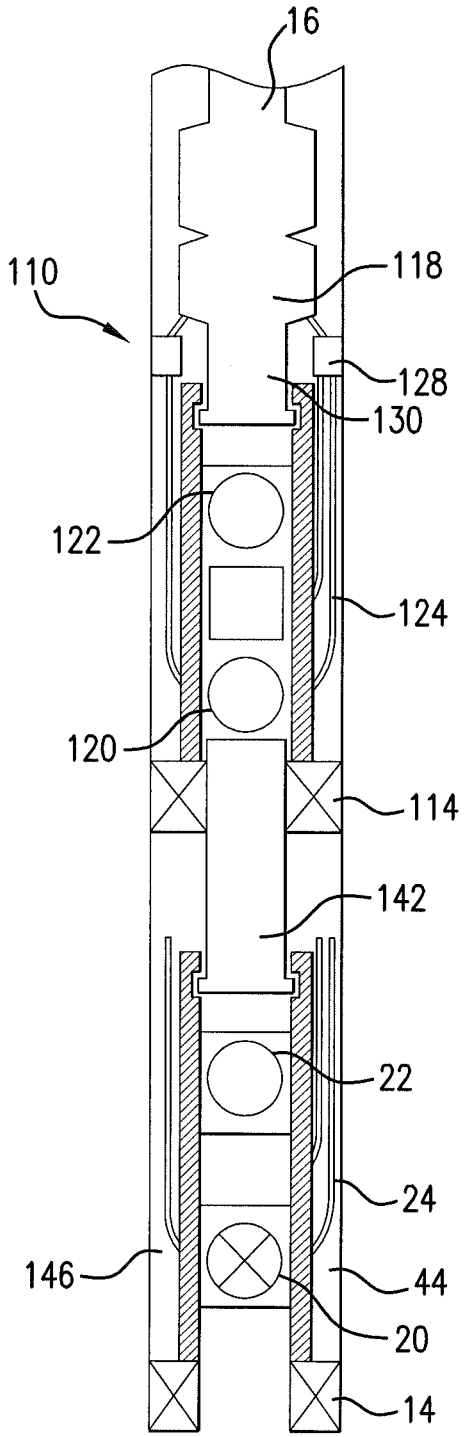
FIG. 3 is a schematic view of a new stackable multi-barrier system engaged with the remains of the system illustrated in FIG. 1.

In order to restore production, another system 110 is attached at a downhole end of upper completion 16 and run in the hole. This is illustrated in FIG. 3. The original system 10 has components such as packer 14, valves 20 and 22 and control lines 24 are seen at the bottom of the drawing and a new system 110 stackable on the last is shown. The new system 110 includes a packer 114 valve 120, valve 122, lines 124, stroker 13, ESP 118 and releasable hydraulic line device 128. In essence each of the components of system 10 is duplicated in system 110. Moreover, it should be understood that the process of pulling out and stabbing in with new systems can go on ad infinitum (or at least until practicality dictates otherwise).

Figure 4:
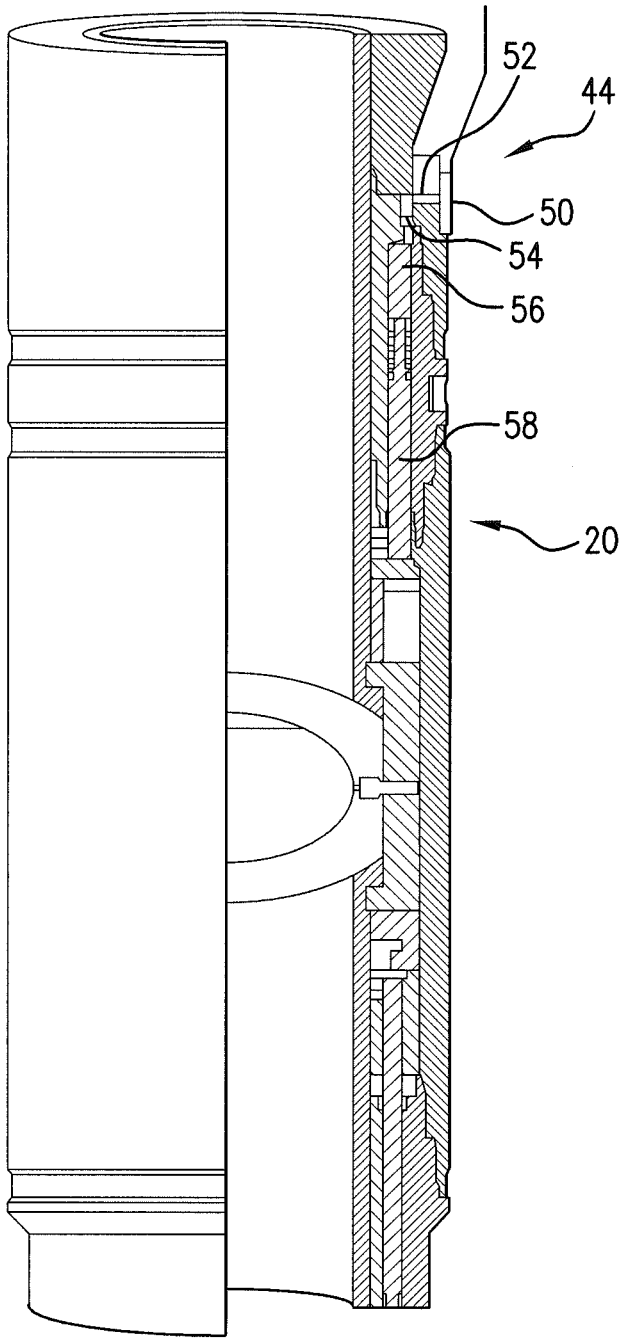
FIG. 4 depicts a quarter cross sectional view of a portion of a hydraulically actuated valve employed in the stackable multi-barrier system of FIGS. 1-3.

Since the valves 20 and 22 will be in the closed position, having been intentionally closed upon preparing to retrieve the upper completion 16, they will need to be opened upon installation of the new system 110. This is accomplished by stabbing a mechanical shiftdown 142 into valve 22 and setting packer 114. The mechanical shiftdown 142 mechanically shifts the valve 22 to the open position. It should be pointed out that, in this embodiment, the mechanical shiftdown 142 does not seal to the valve 22 and as such the inside of the upper completion 16 is in fluidic communication with annular space 146 defined between the packers 14 and 114. Applying pressure to the tubing at this point will result in a pressure buildup that will act on the valve 20 through the string uphole thereof since all valves thereabove, 22, 120 and 122 are in the open position. Referring to FIG. 4, a view of valve 20 illustrates the provision 44 that includes a port 52 in operable communication with an optional shifter 50. The shifter 50 is configured to open the port 52 in response to retrieval of the upper completion 16. As illustrated the shifter 50 in this embodiment is a sleeve that is automatically actuated upon retrieval of the upper completion 16. More specifically, when upper completion 16 begins to move uphole, the provision 44 is shifted to the open position. When the provision 44 is in the open position tubular fluid pressure is in communication with the port 52. The port 52 includes an openable member 54 such as a burst disk or similar that when opened provides fluid access to an atmospheric chamber 56. The member 54 opens upon increased tubing pressure and allows fluid to fill the atmospheric chamber 56. Fluid in the atmospheric chamber causes one or more pistons 58 to urge the valve 20 to the open position. In one embodiment, ratcheting devices (not shown) may be provided in operable communication with the one or more pistons 58 to prevent the pistons from moving in a direction to allow the valve to close by serendipity at some later time. It may also be that the valve 20 itself is configured to be locked permanently open by other means if the atmospheric chamber floods.

The foregoing apparatus and method for its use allows for the retrieval and replacement of an upper completion without the need for a wet connection. It will be further appreciated in view of the below that certain components, aspects, features, elements, etc. of the above described embodiments can be utilized in other completion systems. For example, as disclosed above, features of the system 10 can be used to enable barrier valves of other systems to "automatically" close when the upper completion is pulled out, i.e., transition to a closed position based upon mechanical movement of the upper completion as taught above.

Figure 5:
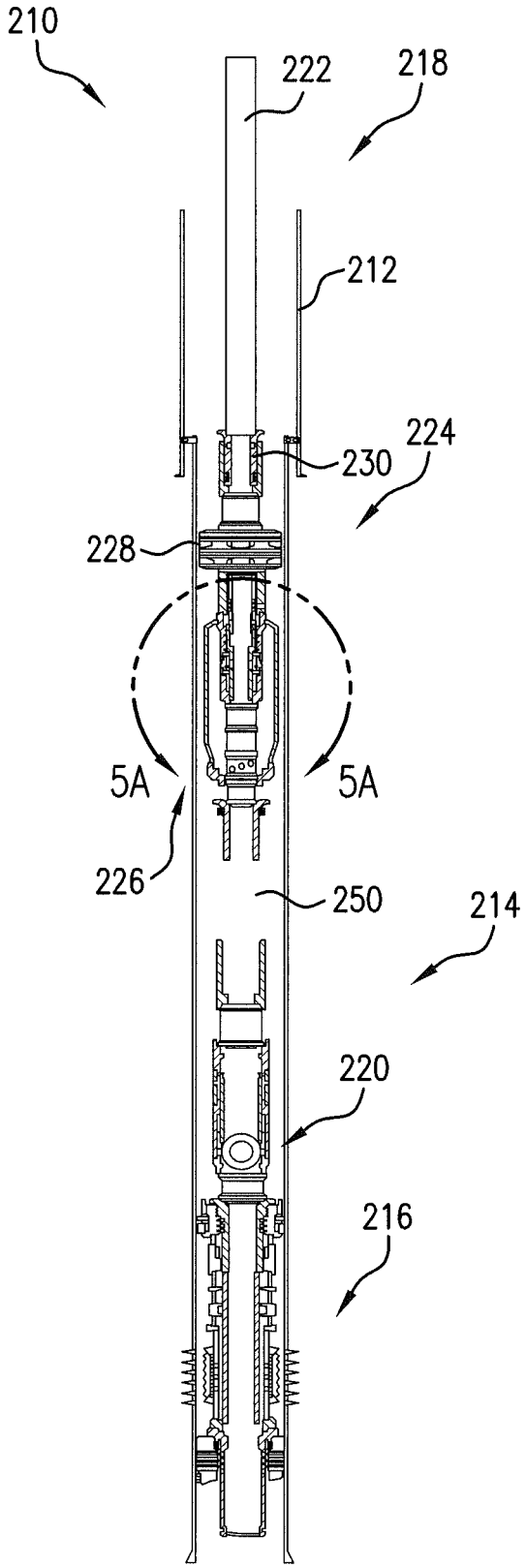
FIG. 5 is a partial cross-sectional view of a completion system in which an intermediate assembly is being engaged with a lower completion.

Referring now to FIG. 5, a completion system 210 is shown installed in a borehole 1&& (cased, lined, open hole, etc.). The system 210 includes a lower completion 214 including a gravel or frac pack assembly 216 (or multiples thereof for multiple producing zones) that is isolated from an upper completion 218 of the system 210 by a fluid loss or fluid isolation valve 220. The gravel or frac pack assembly 216 and the valve 220 generally resemble those known and used in the art. That is, the gravel or frac pack assembly 216 enables the fracturing of various zones while controlling sand or other downhole solids, while the valve 220 takes the form of a ball valve that is transitionable between a closed configuration (shown in FIG. 5) and an open configuration (discussed later) due to cycling the pressure experienced by the valve 220 or other mechanical means, e.g., through an intervention with wireline or tubing. Of course, known types of fluid loss valves other than ball valves could be used in place of the valve 220. Additionally, it is to be appreciated that the lower completion 214 could include components and assemblies other than, or in addition to, the frac pack and/or gravel pack assembly 216, such as for enabling stimulation, hydraulic fracturing, etc.

Figure 5A:
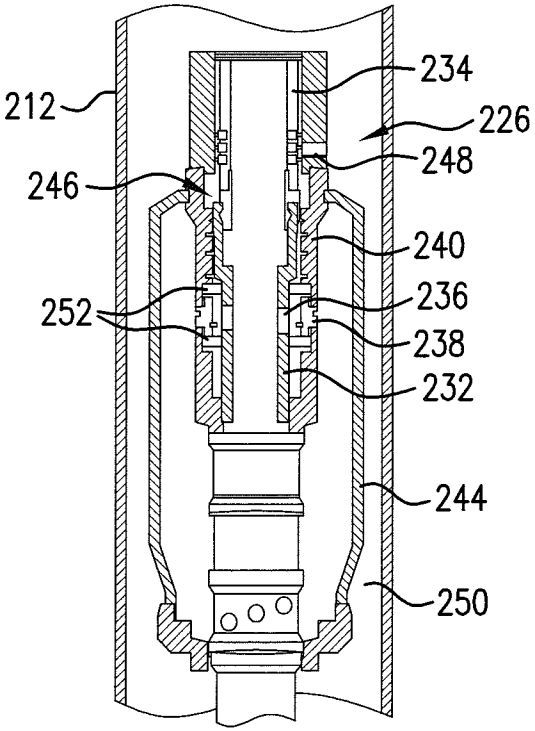
FIG. 5A is an enlarged view of the area circled in FIG. 5.

The system 210 also includes a work string 222 that enables an intermediate completion assembly 224 to be run in. Essentially, the assembly 224 is arranged for functionally replacing the valve 220. That is, while the valve 220 remains physically downhole, the assembly 224 assumes or otherwise takes off at least some functionality of the valve 220, i.e., the assembly 224 provides isolation of the lower completion 214 and the formation and/or portion of the borehole 212 in which the lower completion 214 is positioned. Specifically, in the illustrated embodiment, the assembly 224 in the illustrated embodiment is a fluid loss and isolation assembly and includes a barrier valve 226 and a production packer or packer device 228. By packer device, it is generally meant any assembly arranged to seal an annulus, isolation a formation or portion of a borehole, anchor a string attached thereto, etc. The barrier valve 226 is shown in more detail in FIG. 5A. Initially, as shown in FIGS. 5 and 5A, a shifting tool 230 holds a sleeve 232 of the barrier valve 226 in an open position by an extension 234 of the shifting tool 230 that extends through the packer 228. The term "shifting tool" is used broadly and encompasses seal assemblies and devices that allow relative movement or shifting of the sleeve 232 other than the tool 230 as illustrated. When the sleeve 232 is in its open position, a set of ports 236 in the sleeve 232 are axially aligned with a set of ports 238 in a housing or body 240 of the barrier valve 226, thereby enabling fluid communication through the barrier valve 226. Of course, movement of the sleeve 232 for enabling fluid communication is not limited to axial, although this direction of movement conveniently corresponds with the direction of movement of the work string 222. In the illustrated embodiment, a shroud 244 is radially disposed with the barrier valve 226 for further controlling and/or regulating the flow rate, pressure, etc. of fluid, i.e., by redirecting fluid flow from the lower completion 214 out into the chamber formed by the shroud 244, and back into the barrier valve 226 via the ports 236 and 238 when the valve 226 is open. In the illustrated embodiment, the extension 234 of the shifting tool 230 (and/or the sleeve 232) includes a releasable connection 246 for enabling releasable or selective engagement between the tool 230 and the sleeve 232. For example, the connection 246 could be formed by a collet, spring-loaded or biased fingers or dogs, etc.

Figure 6:
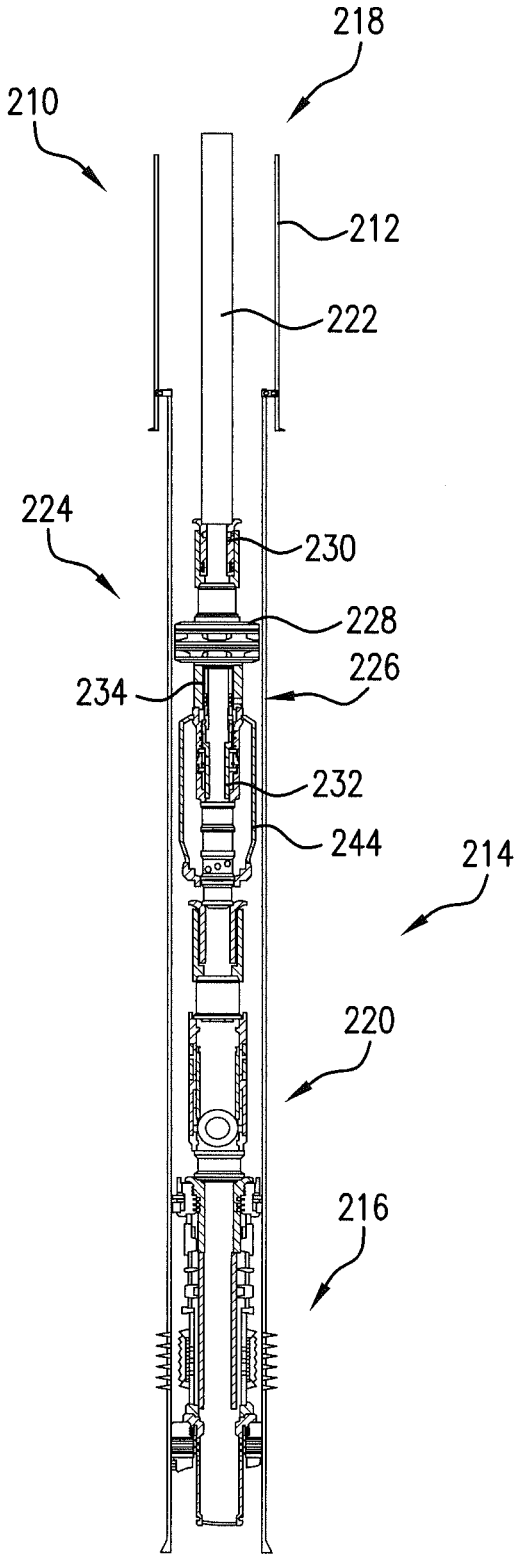
FIG. 6 is a partial cross-sectional view of the completion system of FIG. 1 in which the intermediate assembly is engaged with the lower completion.

A method of assembling and using the completion 210 according to one embodiment is generally described with respect to FIGS. 5-13. As illustrated in FIG. 5, the work string 222 with the assembly 224 is initially run in for connection to the lower completion 214, thereby providing a fluid pathway to surface and enabling production. For example, while circulating fluids in the borehole 212, the assembly 224 can be properly positioned by lowering the work string 222 until circulation stops. After noting the location and slacking off on the work string, the assembly 224 is landed at the lower completion 214, as shown in FIG. 6. Once landed at the lower completion 214, the production packer 228 is set, e.g., via hydraulic pressure in the work string 222, thereby isolating and anchoring the assembly 224. At this point, the barrier valve 226 is open and an equalizing port 248 between the interior of the work string 222 and an annulus 250 is closed by the extension 234 of the shifting tool 230.

Figure 7A:
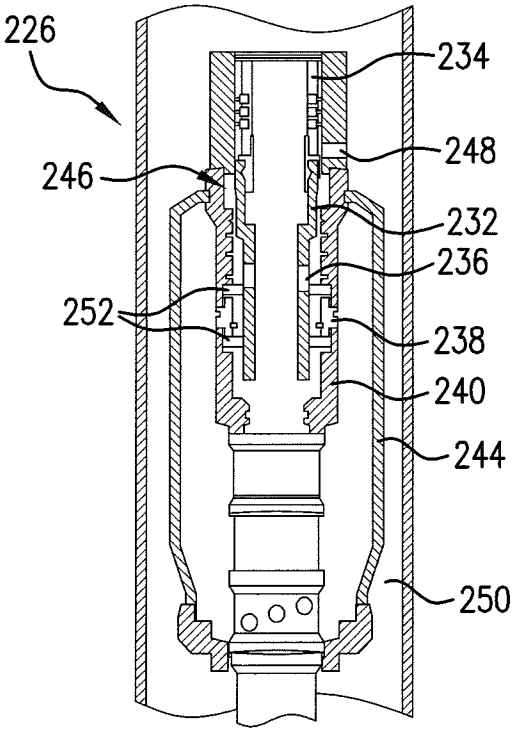
FIG. 7A is an enlarged view of the area circled in FIG. 7.
Figure 7:
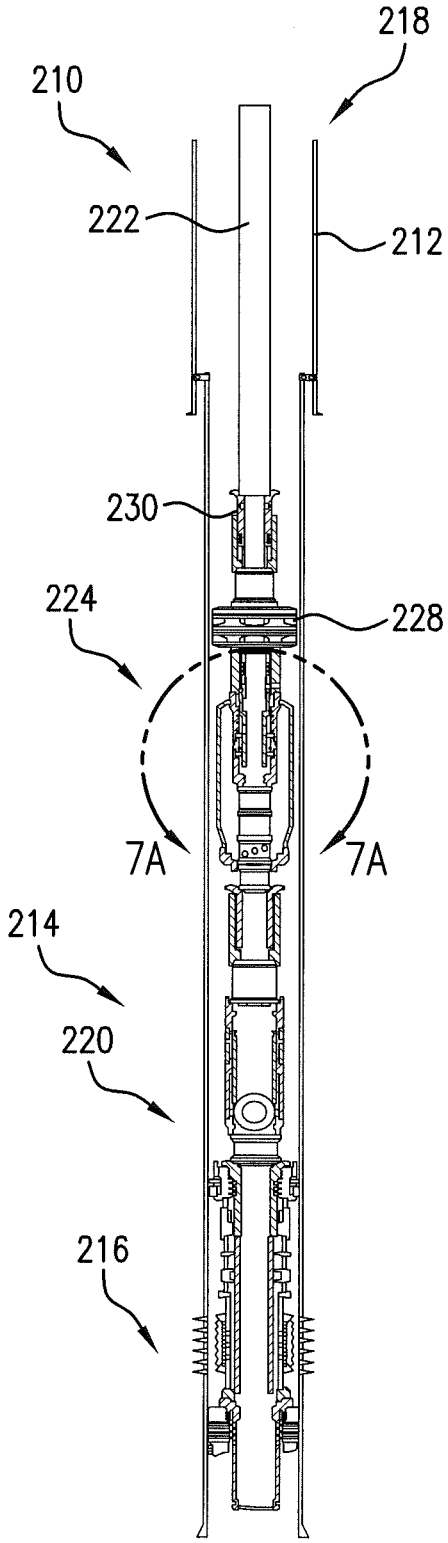
FIG. 7 is a partial cross-sectional view of the completion system of FIG. 1 in which a barrier valve of the intermediate assembly is closed for testing a packer of the intermediate assembly.
Figure 8:
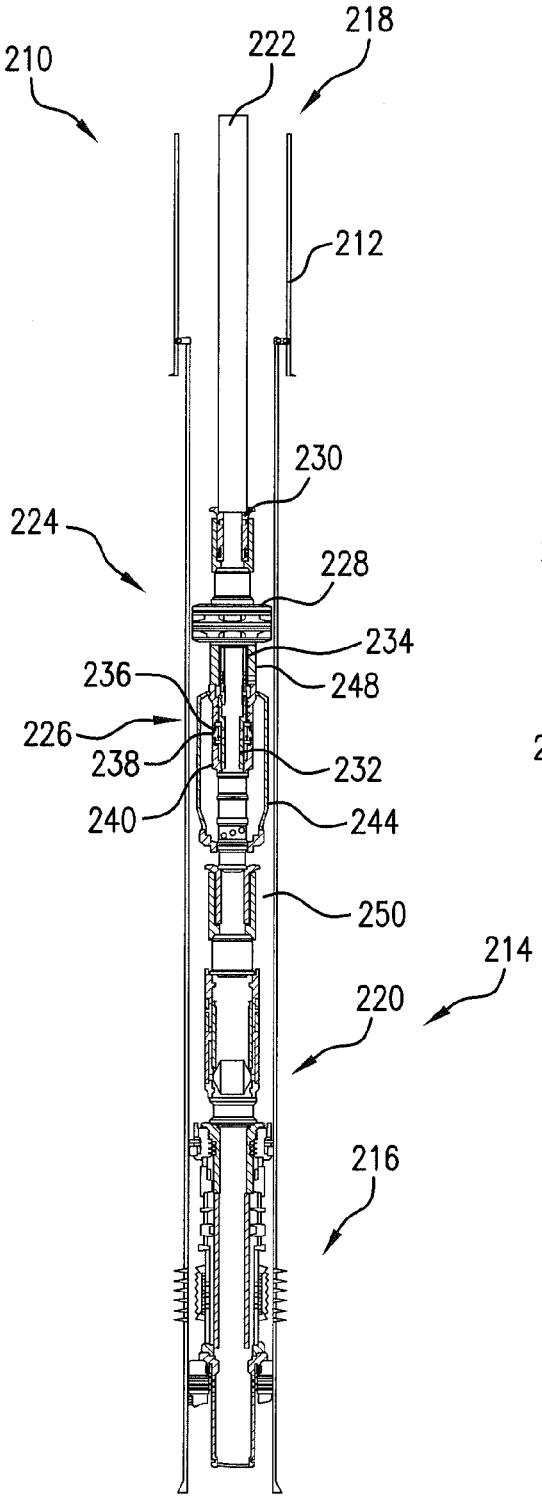
FIG. 8 is a partial cross-sectional view of the completion system of FIG. 1 in which a fluid isolation valve for the lower completion is opened.

As illustrated in FIG. 7, the work string 222 can then be pulled out in order to axially misalign the ports 236 and 238, which closes the barrier valve 226. That is, as shown in more detail in FIG. 7A, communication through the port 238 and into the barrier valve 226 is prevented by a pair of seal elements 252 sealed against the sleeve 232. As also shown in more detail in FIG. 7A, pulling out the work string 222 slightly also opens the equalizing port 248, enabling the packer 228 to be tested on the annulus 250 and/or down the work string 222.

Figure 9:
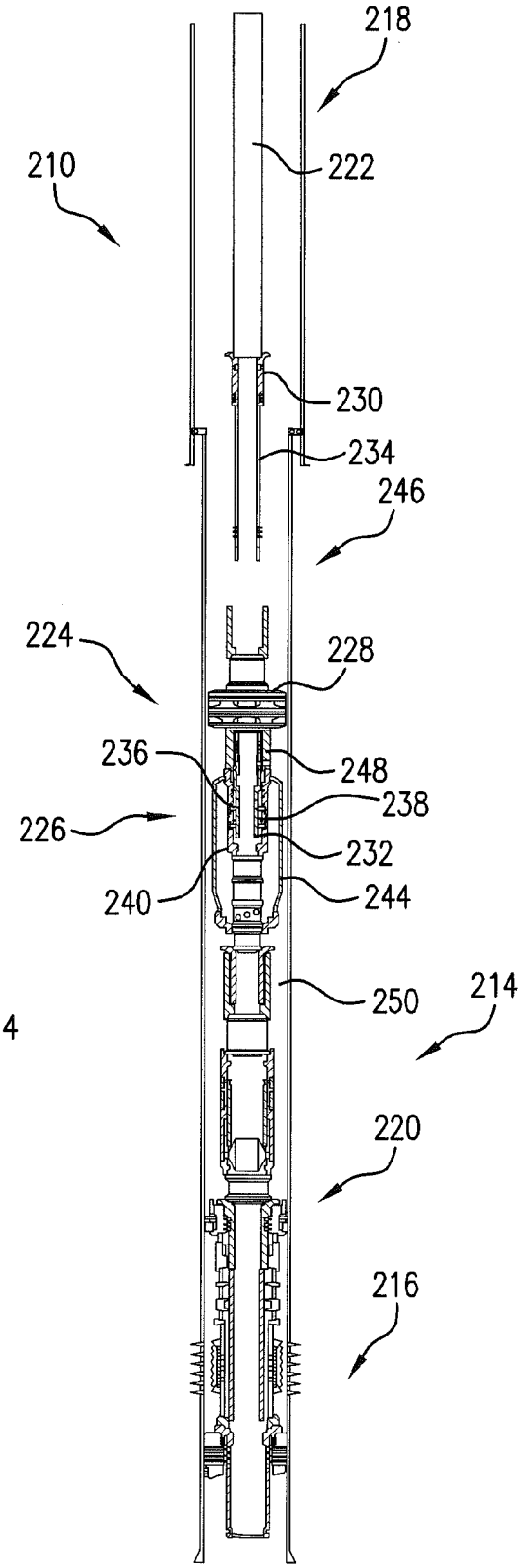
FIG. 9 is a partial cross-sectional view of the completion system of FIG. 1 in which a work string on which the intermediate assembly was run-in is pulled out, thereby closing the barrier valve of the intermediate assembly.

As depicted in FIG. 8, by again slacking off on the work string 222, the barrier valve 226 re-opens (e.g., taking the configuration shown in FIG. 5A) and pressure can be cycled in the work string 222 for opening the fluid loss valve 220. Next, as shown in FIG. 9, the work string 222 is pulled out of the borehole 212. Pulling out the work string 222 first shifts the sleeve 232 into its closed position (e.g., as shown in FIG. 7A) for the barrier valve 226. Then due to the packer 228 anchoring the assembly 214, continuing to pull out the work string 222 disconnects the tool 230 from the sleeve 232 at the releasable connection 246.

Figure 10:
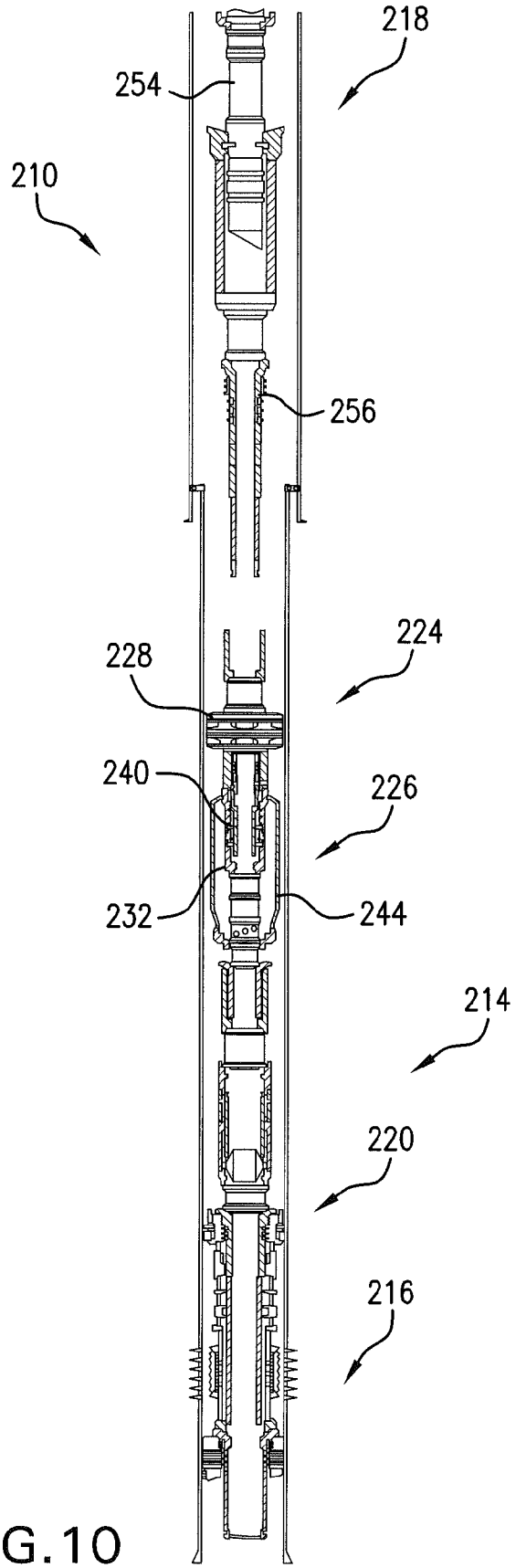
FIG. 10 is a partial cross-sectional view of the completion system of FIG. 1 in which a production string is being run-in for engagement with the intermediate assembly.
Figure 11:
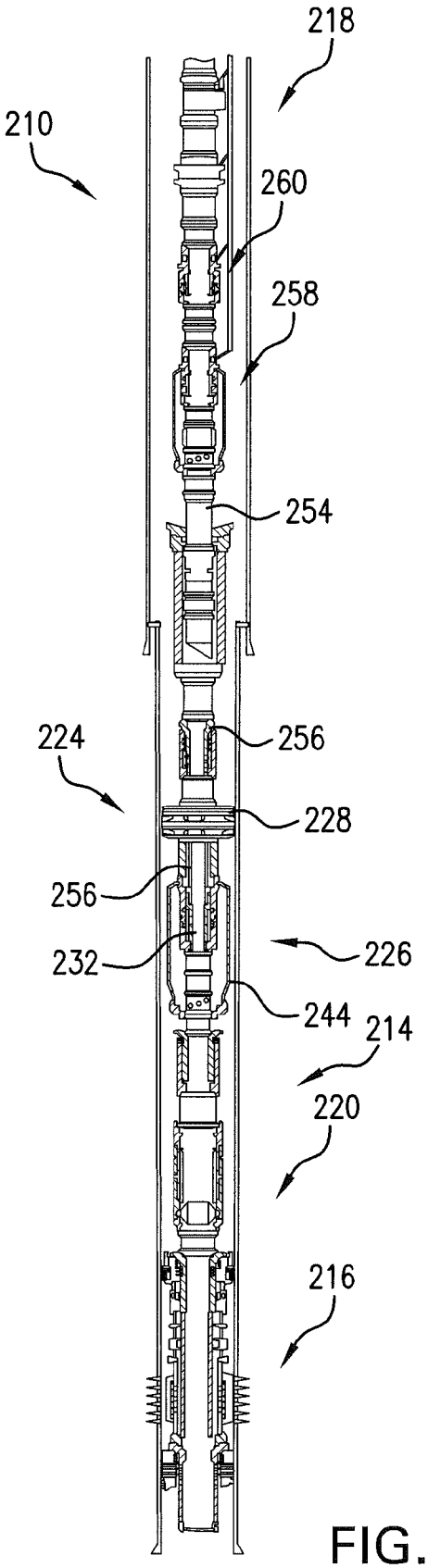
FIG. 11 is a partial cross-sectional view of the completion system of FIG. 1 in which the production string is engaged with the intermediate assembly for opening the barrier valve and enabling production from the lower completion.

In order to start production, a production string 254 is run and engaged with the assembly 224 as shown in FIGS. 10 and 11. The production string 254 includes a shifting tool 256 similar to the tool 230, i.e., arranged with a releasable connection to selectively open and close the barrier valve 226 by manipulating the sleeve 232. In this way, the production string 254 is first landed at the assembly 224 and the tool 230 extended through the packer 228 for shifting the sleeve 232 to open the barrier valve 226. Once the barrier valve 226 is opened, a tubing hanger supporting the production string 254 is landed and fluid from the downhole zones, i.e., proximate to the frac or gravel pack assembly 216, can be produced. In the illustrated embodiment the production string 254 takes the form of an artificial lift system, particularly an ESP system for a deepwater well, which are generally known in the art. However, it is to be appreciated that the current invention as disclosed herein could be used in non-deepwater wells, without artificial lift systems, with other types of artificial lift systems, etc.

Workovers are a necessary part of the lifecycle of many wells. ESP systems, for example, are typically replaced about every 8-10 years, or some other amount of time. Other systems, strings, or components in the upper completion 218 may need to be similarly removed or replaced periodically, e.g., in the event of a fault, damage, corrosion, etc. In order to perform the workover, reverse circulation may be performed by closing a circulation valve 258 and shifting open a hydraulic sliding sleeve 260 of the production string 254. Advantageously, if the production string 254 or other portions in the upper completion 218 (i.e., up-hole of the assembly 224) needs to be removed, removal of that portion will "automatically" revert the barrier valve 226 to its closed position, thereby preventing fluid loss. That is, the same act of pulling out the upper completion string, e.g., the production string 254, the work string 222, etc., will also shift the sleeve 232 into its closed position and isolate the fluids in the lower completion. This eliminates the need for expensive and additional wireline intervention, hydraulic pressure cycling, running and/or manipulating a designated shifting tool, etc. The packer 228 also remains in place to maintain isolation. This avoids the need for expensive and time consuming processes, such as wireline intervention, which may otherwise be necessary to close a fluid loss valve, e.g., the valve 220.

Figure 12:
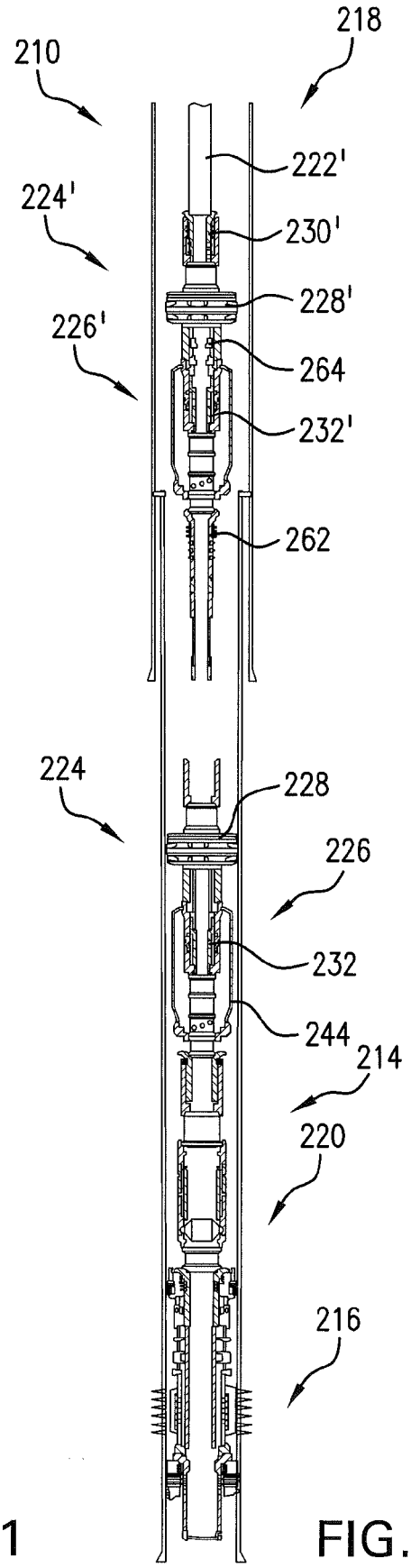
FIG. 12 is a partial cross-sectional view of the completion system of FIG. 1 in which the production string has been pulled out, thereby closing the barrier valve of the intermediate assembly and a subsequent intermediate assembly is being run-in for engagement with the original intermediate assembly.
Figure 13:
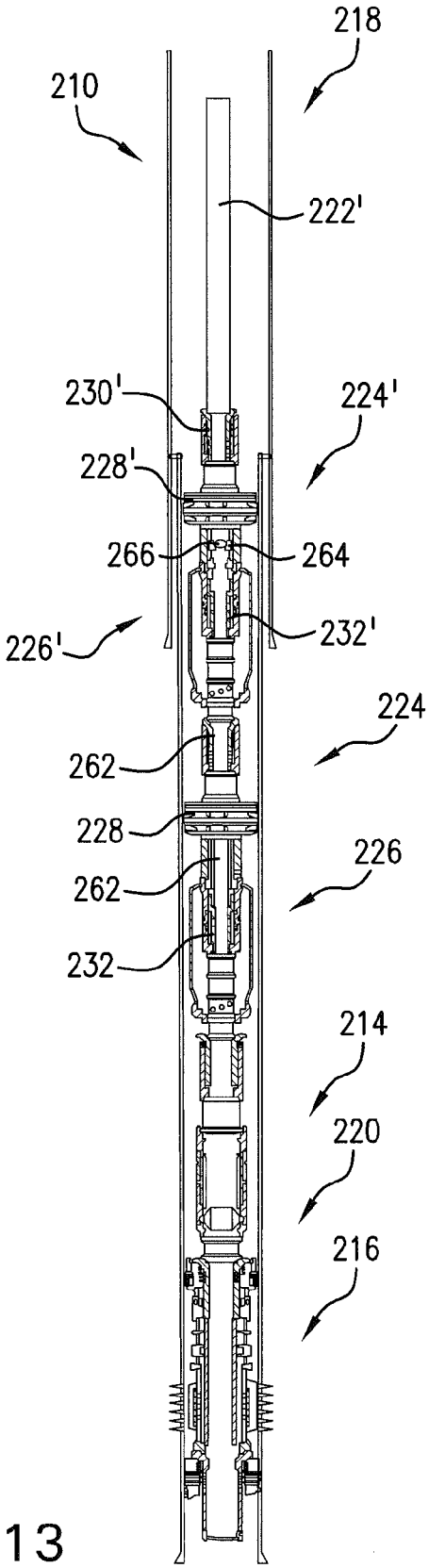
FIG. 13 is a partial cross-sectional view of the completion system of FIG. 1 in which the subsequent intermediate assembly is stacked on the original intermediate assembly.

A replacement string, e.g., a new production string resembling the string 254, can be run back down into the same intermediate completion assembly, e.g., the assembly 224. Alternatively, if a long period of time has elapsed, e.g., 8-10 years as indicated above with respect to ESP systems, it may instead be desirable to run in a new intermediate completion assembly, as equipment wears out over time, particularly in the relatively harsh downhole environment. For example, as shown in FIGS. 12 and 13 an additional or subsequent intermediate completion assembly 224' is run in on a work string 222' for engagement with the original assembly 224. As noted above with respect to the valve 220, the subsequent assembly 224' essentially functionally replaces the original assembly 224. That is, the subsequent assembly 224' substantially resembles the original assembly 224, including a barrier valve 226' for preventing fluid loss, a production packer 228' for reestablishing isolation, and a sleeve 232' that is manipulated by a shifting tool 230' on the work string 222'. It should be appreciated that the aforementioned components associated with the assembly 224' include prime symbols, but otherwise utilize the same base reference numerals as corresponding components described above with respect to the assembly 224, and the above descriptions generally apply to the corresponding components having prime symbols and of the assembly 224' (even if unlabeled), unless otherwise noted.

Unlike the assembly 224, the assembly 224' has a shifting tool 262 for shifting the sleeve 232 of the original assembly 224 in order to open the barrier valve 226, which was closed by the shifting tool 256 when the production string 254 was pulled out. As long as the assembly 224' remains engaged with the assembly 224, the tool 262 will mechanically hold the barrier valve 226 in its open position. In this way, the assembly 224' can be stacked on the assembly 224 and the barrier valve 226' will essentially take over the fluid loss functionality of the barrier valve 226 of the assembly 224 by holding the barrier valve 226 open with the tool 262. It is to be appreciated that any number of these subsequent assemblies 224' could continue to be stacked on each other as needed. For example, a new one of the assemblies 224' could be stacked onto a previous assembly between the acts of pulling out an old upper completion or production string and running in a new one. In this way, the newly run upper completion or production string will interact with the uppermost of the assemblies 224' (as previously described with respect to the assembly 224 and the production string 254), while all the other intermediate assemblies are held open by the shifting tools of the subsequent assemblies (as previously described with respect to the assembly 224 and the shifting tool 262).

The shifting tool 230' also differs from the shifting tool 230 to which it corresponds. Specifically, the shifting tool 230' includes a seat 264 for receiving a ball or plug 266 that is dropped and/or pumped downhole. By blocking flow through the seat 264 with the plug 266, fluid pressure can be built up in the work string 222' suitable for setting and anchoring the production packer 228'. That is, pressure was able to be established for setting the original packer 228 because the fluid loss valve 220 was closed, but with respect to FIGS. 12 and 13 the valve 220 has since been opened and fluid communication established with the lower completion 214 as described previously.

After setting the packer 228', the string 222' can be pulled out, thereby automatically closing the sleeve 232' of the barrier valve 226' as previously described with respect to the assembly 224 and the work string 222 (e.g., by use of a releasable connection). As previously noted, the original barrier valve 226 remains opened by the shifting tool 262 of the subsequent assembly 224'. As the assembly 224' has essentially taken over the functionality of the original assembly 224 (i.e., by holding the barrier valve 226 constantly open with the tool 262), a new production string, e.g., resembling the production string 254, can be run in essentially exactly as previously described with respect to the production string 254 and the assembly 224, but instead engaged with the assembly 224'. That is, instead of manipulating the barrier valve 226, the shifting tool (e.g., resembling the tool 256) of the new production string (e.g., resembling the string 254) will shift the sleeve 232' of the barrier valve 226' open for enabling production of the fluids from the downhole zones or reservoir.

It is again to be appreciated that any number of the assemblies 224' can continue to be run in and stacked atop one another. For example, this stacking of the assemblies 224' can occur between the acts of pulling out an old production string and running a new production string, with the pulling out of each production string "automatically" closing the uppermost one of the assemblies 224' and isolating the fluid in the lower completion 214. In this way, any number of production strings, e.g., ESP systems, can be replaced over time without the need for expensive and time consuming wireline intervention, hydraulic pressure cycling, running and/or manipulation of a designated shifting tool, etc. Additionally, the stackable nature of the assemblies 224, 224', etc., enables the isolation and fluid loss hardware to be refreshed or renewed over time in order to minimize the likelihood of a part failure due to wear, corrosion, aging, etc.

Figure 14:
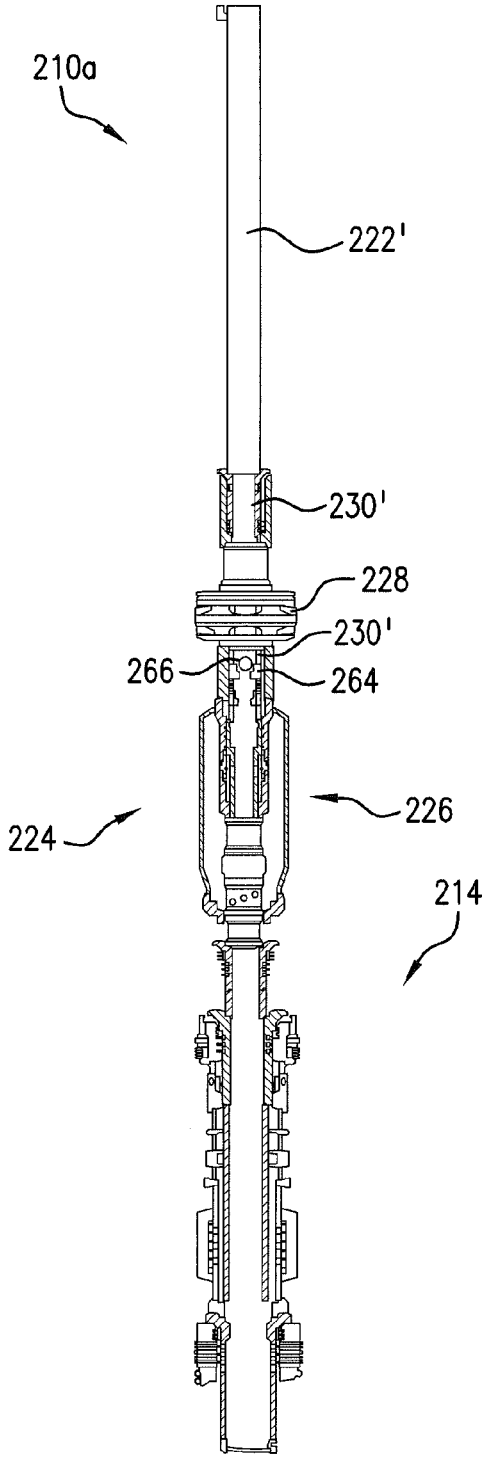
FIG. 14 is a partial cross-sectional view of a completion system according to another embodiment disclosed herein.

It is noted that the fluid loss valve 220 can be substituted, for example, by the assembly 224 being run in on a work string resembling the work string 222' as opposed to the work string 222. For example, as shown in FIG. 12, a modified system 210*a* includes the assembly 224 being run in on the work string 222'. In this way, fluid pressure suitable for setting the original packer 228 can be established by use of the ball seat 264 and the plug 266 instead of the valve 220. Accordingly, as illustrated in FIG. 14, the fluid loss valve 220 is rendered unnecessary or redundant by use of the system 210*a*, as the plug 266 and the seat 264 of the work string 222' enable suitable pressurization for setting the packer 228, and the tool 230' of the work string 222' enables control of the barrier valve 226 such that the assembly 224 can completely isolate the lower completion 214. After isolating the lower completion 214, a production string, e.g., the string 254, subsequent intermediate assemblies, etc., can be run in and interact with the assembly 224 as described above.

Figure 15:
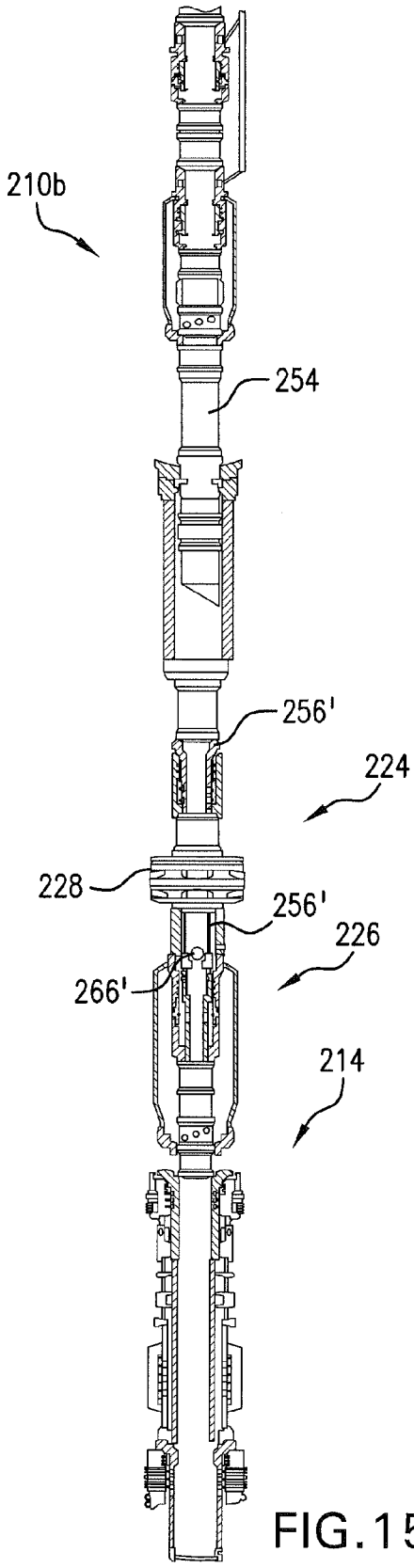
FIG. 15 is a partially cross-sectional view of a completion system according to another embodiment disclosed herein.

As another example, a modified system 210*b* is illustrated in FIG. 15. The system 210*b* is similar to the system 210*a* in that a separate fluid isolation valve for the lower completion 214, e.g., the valve 220, is not necessary and instead the system 210*b* can be run in for initially isolating the lower completion 214. Unlike the system 210*a*, the system 210*b* is capable of being run-in immediately on the production string 254 without the need for the work string 222' of the system 210*a*. Specifically, the system 210*b* is run-in with a plug 266' already located in a shifting tool 256' of the production string 254. The tool 256' resembles the tool 256 with the exception of being arranged to hold the plug 266' therein for blocking fluid flow therethrough. By running the plug 266' in with the system 210*b*, the plug 266' does not need to be dropped and/or pumped from surface, as this would be impossible for various configurations of the production string 254, e.g., if the string 254 includes ESPs or other components or assemblies that would obstruct the pathway of a dropped plug down through the string. The plug 266' is arranged to be degradable, consumable, disintegrable, corrodible, dissolvable, chemically reactable, or otherwise removable so that once it has been used for providing the hydraulic pressure necessary to set the packer 228, the plug 266' can be removed and enable production through the string 254. In one embodiment the plug 266' is made from a dissolvable or reactive material, such as magnesium or aluminum that can be removed in response to a fluid deliverable or available downhole, e.g., acid, brine, etc. In another embodiment, the plug 266' is made from a controlled electrolytic material, such as made commercially available by Baker Hughes, Inc. under the tradename INTALLIC®. Once the plug 266' is removed, the system 210*b* would function as described above with respect to the system 210.

It is thus noted that the current invention as illustrated in FIGS. 5-13 is suitable as a retrofit for systems that are in need of a workover, i.e., need to have the upper completion replaced or removed, but already includes a valve resembling the fluid loss valve 220 (e.g., a ball valve or some other type of valve used in the art that requires wireline intervention, hydraulic pressure cycling, the running and/or manipulation of designated shifting tools, etc., in order to transition between open and closed configurations). Alternatively stated, the system 210 enables downhole isolation of a lower completion for performing a workover, i.e., removal or replacement of an upper completion, without the need for time consuming wireline or other intervention.

In view of the foregoing it is to be appreciated that new completions can be installed with a valve, e.g., the fluid loss valve 220, that requires some separate intervention and/or operation to close the valve during workovers, or, alternatively, according to the systems 210*a* or 210*b*, which not only initially isolate a lower completion, e.g., the lower completion 214, but additionally include a barrier valve, e.g., the barrier valve 226, that automatically closes upon pulling out the upper completion, as described above.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A completion system, comprising:

an intermediate assembly for location between an upper completion and a lower completion, the intermediate assembly having a barrier valve transitionable between an open position and a closed position, the intermediate assembly further including a packer device for isolating the borehole, anchoring the intermediate assembly, or a combination including at least one of the foregoing; and the upper completion being a production string, run in with a removable plug, the plug for enabling the packer device of the intermediate assembly to be set by pressurizing fluid against the removable plug the upper completion, the upper completion being operatively coupled with the barrier valve for mechanically transitioning the barrier valve to the closed position in response to the upper completion being withdrawn from the lower completion.

2. The completion system of claim 1, wherein mechanical movement of the upper completion also enables the upper completion to transition the barrier valve to the open position.

3. The completion system of claim 1, wherein the upper completion includes a stroker that is actuatable by fluid pressure for mechanically moving the barrier valve between the open and closed positions.

4. The completion system of claim 1, wherein the lower completion includes at least one assembly for enabling stimulation, hydraulic fracturing, frac packing, gravel packing, or a combination including at least one of the foregoing.

5. The completion system of claim 1, wherein the upper completion string includes a shifting tool that extends through the packer device for engagement with the barrier valve.

6. The completion system of claim 1, further comprising a subsequent intermediate assembly stacked with the intermediate assembly, the subsequent intermediate assembly having a subsequent barrier valve.

7. The completion system of claim 6, wherein the intermediate assembly is engaged between the subsequent intermediate assembly and the lower completion and the subsequent intermediate assembly is engaged between the intermediate assembly and the upper completion string.

8. The completion system of claim 1, wherein the production string comprises an artificial lift system.

9. A completion system, comprising:

an intermediate assembly for location between an upper completion and a lower completion, the intermediate assembly having a barrier valve transitionable between an open position and a closed position;

a subsequent intermediate assembly stacked with the intermediate assembly, the subsequent intermediate assembly having a subsequent barrier valve, the intermediate assembly being engaged between the subsequent intermediate assembly and the lower completion and the subsequent intermediate assembly being engaged between the intermediate assembly and the upper completion;

wherein the upper completion includes a first tool operatively arranged for enabling the subsequent barrier valve to transition between open and closed positions and the subsequent intermediate assembly is arranged with a second tool for holding the barrier valve in its open position while the subsequent intermediate assembly is engaged with the first intermediate assembly.

10. A method of operating a completion system, comprising:

withdrawing an upper completion, the upper completion operatively coupled to a barrier valve, that is part of intermediate assembly located between a lower completion and the upper completion, for controlling operation of the barrier valve; and closing the barrier valve mechanically due to the withdrawing:

wherein the upper completion string includes a removable plug, and the method further comprises pressurizing against the removable plug for setting a packer device of the intermediate assembly and removing the removable plug.

11. The method of claim 10, further comprising:

running in the upper completion or a subsequent upper completion; and opening the barrier valve mechanically due to the running in.

12. A method of operating a completion system, comprising:

withdrawing an upper completion, the upper completion operatively coupled to a barrier valve for controlling operation of the barrier valve; and closing the barrier valve mechanically due to the withdrawing, the method further comprising stacking a subsequent intermediate assembly on the intermediate assembly, the subsequent intermediate assembly having a subsequent barrier valve and holding the barrier valve of the intermediate assembly in the open position, the upper completion being operatively engagable with the subsequent intermediate assembly for transitioning the subsequent intermediate assembly between open and closed positions.

13. The method of claim 10, wherein the barrier valve is part of a lower completion.

14. The method of claim 10, further comprising running the barrier valve in on the upper completion.

15. The method of claim 10, wherein the upper completion is a production string.

* * * * *